US008866406B2

(12) United States Patent
Gordin et al.

(10) Patent No.: US 8,866,406 B2
(45) Date of Patent: Oct. 21, 2014

(54) LIGHTING SYSTEM HAVING A MULTI-LIGHT SOURCE COLLIMATOR AND METHOD OF OPERATING SUCH

(71) Applicant: Musco Corporation, Oskaloosa, IA (US)

(72) Inventors: Myron Gordin, Oskaloosa, IA (US); Lawrence H. Boxler, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 13/623,153

(22) Filed: Sep. 20, 2012

(65) Prior Publication Data

US 2013/0077304 A1 Mar. 28, 2013

Related U.S. Application Data

(60) Provisional application No. 61/539,166, filed on Sep. 26, 2011.

(51) Int. Cl.

| | |
|---|---|
| ***H05B 37/02*** | (2006.01) |
| ***F21K 99/00*** | (2010.01) |
| ***F21V 5/00*** | (2006.01) |
| ***F21V 7/22*** | (2006.01) |
| *F21W 131/401* | (2006.01) |
| *F21W 131/406* | (2006.01) |
| *F21W 131/407* | (2006.01) |

(52) U.S. Cl.

CPC ..... *F21V 5/001* (2013.01); *F21W 2131/401* (2013.01); *F21K 9/90* (2013.01); *F21W 2131/406* (2013.01); *F21V 7/22* (2013.01); *F21W 2131/407* (2013.01)

USPC ..... 315/291; 315/312

(58) Field of Classification Search

CPC ..... F21V 15/01; F21V 14/04; F21V 29/2206; F21V 5/04

USPC ..... 315/185 R, 291, 307, 308, 312; 362/227, 235

See application file for complete search history.

(56) References Cited

U.S. PATENT DOCUMENTS

| | | | |
|---|---|---|---|
| 6,019,493 | A | 2/2000 | Kuo et al. |
| 6,617,795 | B2 | 9/2003 | Bruning |

(Continued)

FOREIGN PATENT DOCUMENTS

| | | | |
|---|---|---|---|
| JP | 2011-86569 | A | 4/2011 |
| KR | 10-2007-0004326 | A | 1/2007 |

(Continued)

OTHER PUBLICATIONS

CREE, Inc., "Cree XLamp MC-E LED", CLD-DS16 Rev. 7 Brochure, 2008-2011 , www.cree.com/xlamp, 13 pages.

(Continued)

*Primary Examiner* — Jimmy Vu

(74) *Attorney, Agent, or Firm* — McKee, Voorhees & Sease

(57) ABSTRACT

A lens is provided which is elongated along an axis so to accommodate a linear array of LEDs, the elongation of the lens resulting in a corresponding elongation of the beam output pattern; in practice, the axis of elongation may be oriented so to suit a target area or some portion thereof. A methodology is provided for use with said lens so to evaluate various factors such as droop, heat management, and light output for a given combination of light sources and luminaire design. Alternative designs of lens, as well as alternative optical devices, are also presented for use with said methodology.

19 Claims, 8 Drawing Sheets

(56) References Cited

U.S. PATENT DOCUMENTS

Figure 1:
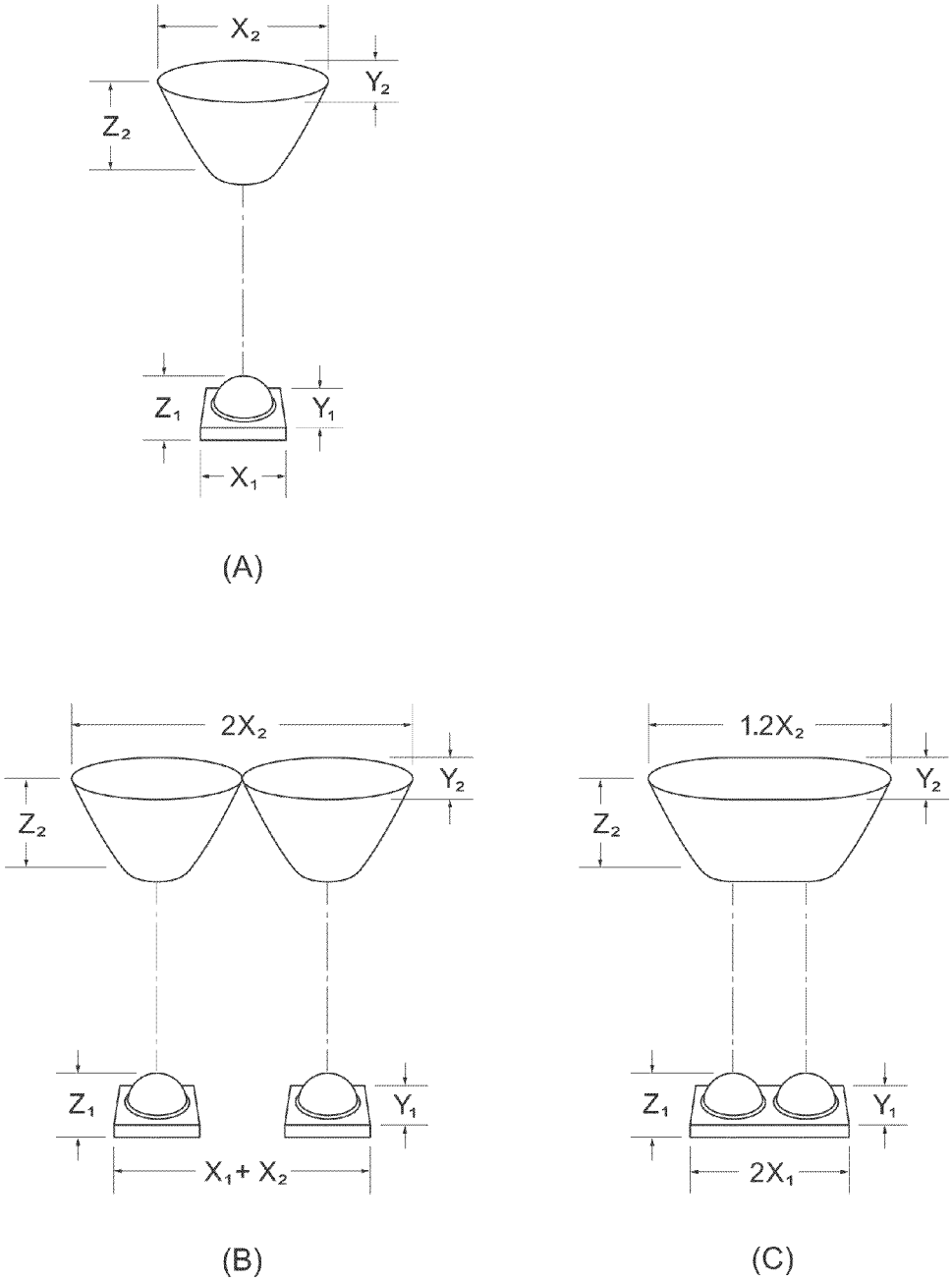
Figure 2:
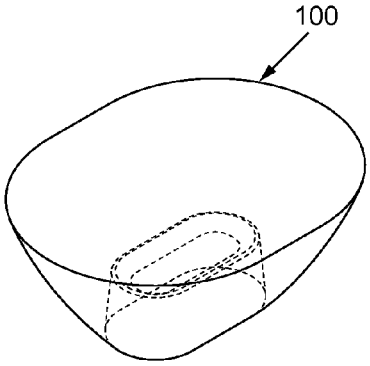
Figure 2:
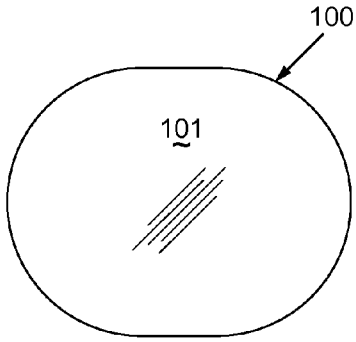
Figure 2:
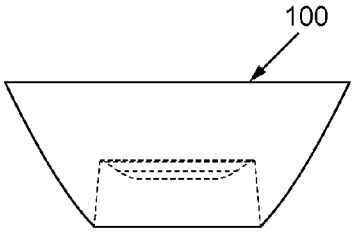
Figure 2:
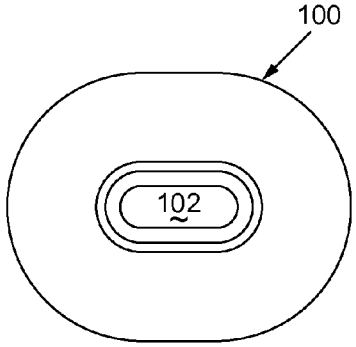
Figure 2:
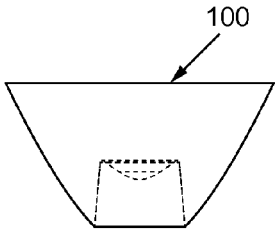

| | | | | |
|---|---|---|---|---|
| 6,998,594 | B2 | 2/2006 | Gaines et al. | |
| 7,023,543 | B2 * | 4/2006 | Cunningham | 356/300 |
| 7,318,658 | B2 | 1/2008 | Wang et al. | |
| 7,618,171 | B2 | 11/2009 | Tessnow et al. | |
| 7,654,686 | B2 | 2/2010 | Oza | |
| 7,731,402 | B2 | 6/2010 | Tessnow et al. | |
| 7,797,117 | B1 | 9/2010 | Gordin | |
| 7,806,558 | B2 | 10/2010 | Williamson | |
| 7,845,824 | B2 | 12/2010 | Robotham | |
| 7,845,827 | B2 | 12/2010 | Tarter et al. | |
| 7,918,591 | B2 | 4/2011 | Lynch | |
| 7,956,551 | B1 | 6/2011 | Gordin | |
| 7,956,556 | B1 | 6/2011 | Gordin et al. | |
| 7,982,404 | B2 | 7/2011 | Gordin | |
| 8,098,024 | B1 | 1/2012 | Gordin | |
| 8,115,217 | B2 | 2/2012 | Duong et al. | |
| 8,177,396 | B2 | 5/2012 | Gordin | |
| 8,237,581 | B2 | 8/2012 | Ries, II | |
| 2007/0145915 | A1 * | 6/2007 | Roberge et al. | 315/312 |
| 2008/0296589 | A1 | 12/2008 | Speier et al. | |
| 2010/0096993 | A1 * | 4/2010 | Ashdown et al. | 315/113 |
| 2012/0217897 | A1 | 8/2012 | Gordin et al. | |

FOREIGN PATENT DOCUMENTS

| | | | |
|---|---|---|---|
| KR | 10-2008-0096015 | A | 10/2008 |
| KR | 10-2009-0108256 | A | 10/2009 |
| WO | 2010133772 | | 11/2010 |
| WO | WO 2013/048853 | A1 | 4/2013 |

OTHER PUBLICATIONS

CREE, Inc., Cree XLamp MC-E LED, http://www.cree.com/products/xlamp_mce.asp., [retrieved from the Internet on Sep. 23, 2011], 4 pages.

CREE, Inc., "Cree XLamp XM-L LEDs", CLD-DS33 Rev 2 Brochure, 2010-2011, www.cree.com/xlamp, 12 pages.

CREE, Inc., "Cree XLamp XM-L LED", http://www.cree.com/products/xlamp_xml.asp [retrieved from the Internet on Sep. 23, 2011], 3 pages.

OSTRAM Opto Semiconductors, "OSTRAM OSTAR Headlamp—Details on Handling, Mounting and Electrical connection" Mar. 2010, pp. 1-10.

Stevenson, Richard, "The LED's Dark Secret", Aug. 2009, http://spectrum.ieee.org/semiconductors/optoelectronics/the-leds-dark-secret/0, [retrieved from the Internet on Jul. 13, 2011], 7 pages.

JP 2011-86569, ENPLAS Corp—English Translation, Date: Mar. 26, 2013.

KR10-2007-0004326, Korea Semiconductor—English Translation, Date: Mar. 26, 2013.

KR10-2008-0096015, VINA Technoloy—English Translation, Date: Mar. 26, 2013.

KR10-2009-0108256, AUTOART—English Translation, Date: Mar. 26, 2013.

MUSCO Corporation, PCT/US2012/056244, filed Sep. 20, 2012, "International Search Report and the Written Opinion of the International Searching Authority", mail date Feb. 28, 2013.

* cited by examiner

PERSPECTIVE VIEW (A)

TOP VIEW (B)

SIDE VIEW (C)

BOTTOM VIEW (D)

END VIEW (E)

(A)

(B)

(A)

PERSPECTIVE VIEW (B)

LIGHTING SYSTEM HAVING A MULTI-LIGHT SOURCE COLLIMATOR AND METHOD OF OPERATING SUCH

CROSS-REFERENCE TO RELATED APPLICATIONS

This application claims priority under 35 U.S.C. §119 to provisional U.S. application Ser. No. 61/539,166, filed Sep. 26, 2011, hereby incorporated by reference in its entirety.

I. BACKGROUND OF THE INVENTION

In the current state of the art, sports and other wide-area lighting applications typically utilize high intensity discharge (HID) lamps; most often, high wattage (e.g., 1000 watt or more), installed in a luminaire elevated high above the target area, and accompanied by a variety of optical devices which help to shape the light projected therefrom. Some typical optical devices used in HID luminaires include reflectors, lenses, visors, or the like and are designed to reflect, collimate, block, or otherwise direct light so to produce the desired beam pattern at or near the target area. In many applications the term "target area" refers not only to the surface where a task is performed, but also a defined space above and/or about said surface. As one example, the space above a baseball field could be considered part of the target area as it is desirable for a ball in flight to be appropriately illuminated throughout its trajectory.

HID lamps, and in particular metal halide HID lamps, are often the light source of choice because of a combination of long operating life (e.g., several thousand hours), high luminous output (e.g., over 100 k lm), high luminous efficacy (e.g., around 100 μm/W), excellent color rendering (e.g., CRI of 65 or more), and ability to mimic natural light (e.g., CCT around 4200K); the latter two features are particularly important for televised events. Over the years the art of designing wide-area HID lighting systems has evolved to address issues such as maintaining minimum light levels, ensuring specified lighting uniformities, and mitigating glare so to satisfy various safety, playability, or light pollution concerns, for example.

That being said, there is room for improvement in the art. For example, while high wattage HID lamps produce a significant amount of light, the lamps themselves are large (e.g., over 300 mm long and over 200 mm in diameter) and often require large and complex optical devices to harness the light and direct it towards the target area; this adds cost and size to the luminaire. Adding to the size of the luminaire often increases wind loading (i.e., drag) and weight; thus the elevating structure (e.g., pole) must be more substantial, which also adds to cost. Even then, there are limits to how much the light emitted from a single source can be shaped to suit a target area. For example, even with a host of optical devices, it is difficult for a single metal halide HID luminaire to adequately illuminate a bend in a road (e.g., as in a cloverleaf interchange) without spill (i.e., light that does not contribute to illumination of the target area and so is wasted).

One solution is to use several smaller (e.g., about 150 mm long and 75 mm in diameter), lower wattage (e.g., 400 watt) HID lamps in place of a single, high wattage HID lamp; this will presumably yield the benefits of HID lamps while potentially permitting a smaller, more compact luminaire with multiple light sources that can be independently controlled. Unfortunately, in the current state of the art lower wattage HID lamps suffer from reduced efficacy (e.g., around 80 lm/W). Given that many sports and other wide-area lighting systems are operated for twenty years or more before lamp replacement, the increased control does not justify the increased cost of operating the lower wattage HID lamps over time.

Light-emitting diodes (LEDs) are an attractive alternative light source because—given the appropriate operating conditions—they have a much longer operating life than HIDs (e.g., tens of thousands of hours) and an efficacy comparable to or exceeding HIDs; further, they can be designed to have a variety of color properties. A wide-area lighting system employing a plurality of LEDs has the potential to illuminate complex target areas in a manner not readily achieved using state-of-the-art HID lamps. That being said, the use of LEDs has not yet extended to sports and other wide-area lighting applications, at least in part, because simply swapping out one type of light source for another does not address the issue of heat management—a factor known to greatly impact the operating life and efficacy of LEDs—which, if not properly addressed, diminishes the benefits of using LEDs.

Another issue of great concern is "droop"—a phenomenon experienced by LEDs wherein efficacy sharply decreases as current increases. Droop is of particular concern for wide-area lighting applications—or any general lighting application—because high operating current is a necessity to make the use of LEDs more affordable. Unfortunately, the tradeoff is a significant decrease in efficacy; in some cases, increasing current beyond several milliamps (mA) results in a drop so severe as to render LEDs less efficient at converting electricity into light than other commercially available light sources (e.g., fluorescents). Further background regarding droop can be provided by a variety of sources including the following publication, the disclosure of which is incorporated by reference herein: "The LED's Dark Secret" [online], [retrieved 2011-07-13]/Retrieved from the Internet: <URL:http://spectrum.ieee.org/semiconductors/optoelectronics/the-leds-dark-secret/0>, published in IEEE Spectrum, vol. 46, issue 8, pp. 26-31 (2009).

Thus, there is a need in the art for sports and other wide-area lighting systems that capitalize on the benefits of LEDs while addressing heat management and droop, and yet, still prove cost-effective when compared to traditional HID systems. This is no easy task as it is estimated that an LED-based sports lighting system can cost several times as much (initially) as a standard HID-based sports lighting system; this is due, at least in part, to the sheer number of LEDs needed to approximate the light output of a single high wattage HID lamp.

One solution is to use LEDs capable of significant light output so fewer are needed to approximate the light output of a traditional HID lamp; presumably, this will increase the cost of the luminaire somewhat but permit greatly increased control of the light projected therefrom. The deficiency here is that because LEDs are still an emerging technology there is a limit to the light output that can be produced while maintaining an acceptable efficacy. Further, there is a limit to the size of optic that can be made to fit LEDs and still be formed by cost-effective molding techniques.

Another solution is to use commercially available LEDs driven at a higher than rated current; presumably, this will produce more light per LED so fewer are needed to approximate the light output of a traditional HID lamp. The deficiency here is that there comes a point when increasing current produces diminishing returns; droop and temperature increases, thereby reducing operating life and efficacy. Thus, there is room for improvement in the art.

II. SUMMARY OF THE INVENTION

To balance the increased cost of using LEDs in a sports or other wide-area lighting application it is desirable for the LEDs to demonstrate an efficacy at least on the order of what is seen in currently-used HID lamps and further, for the LED-based luminaires to have greater control of the light projected therefrom (as compared to currently-used HID luminaires). Ideally, the LED-based luminaires will also demonstrate a longer operating life than traditional wide-area HID luminaires, though this may not be necessary for some applications.

It is therefore a principle object, feature, advantage, or aspect of the present invention to improve over the state of the art and/or address problems, issues, or deficiencies in the art.

Further objects, features, advantages, or aspects according to the present invention may include one or more of the following:

a. means for tailoring an LED-based luminaire to sports and/or other wide-area lighting applications;
b. means for making an LED based-luminaire more cost-effective; and
c. a methodology for balancing heat management, droop, and/or other factors versus light output for a given LED-based luminaire.

According to one aspect of the present invention, a luminaire is designed so to accommodate a plurality of LED modules, each module having one or more optical devices in combination with an envisioned lens, the lens designed to accommodate one or more LEDs in a linear array. In this manner, the aiming of the LED modules within the luminaire as well as the luminaire itself may be adjusted so to produce a desired composite beam output pattern. Also, the number and type of LEDs within each module, as well as input power, may be adjusted so to produce a desired light output level, efficacy, ratio of cost to efficacy, or the like. In essence, according to aspects of the present invention one may tailor the light output, efficacy, or other factors for a particular design of LED luminaire to suit a particular lighting application.

These and other objects, features, advantages, or aspects of the present invention will become more apparent with reference to the accompanying specification and claims.

III. BRIEF DESCRIPTION OF THE DRAWINGS

From time-to-time in this description reference will be taken to the drawings which are identified by figure number and are summarized below.

FIGS. 1A-C illustrate spacing requirements for different combinations of lenses and LEDs. FIG. 1A illustrates, in exploded view, a conventional lens and corresponding LED. FIG. 1B illustrates, in exploded view, two conventional lenses, juxtaposed, and corresponding LEDs. FIG. 1C illustrates, in exploded view, a lens according to an aspect of the present invention with two LEDs, juxtaposed.

FIGS. 2A-E illustrate various detailed views of the envisioned lens of FIG. 1C.

Figure 3:
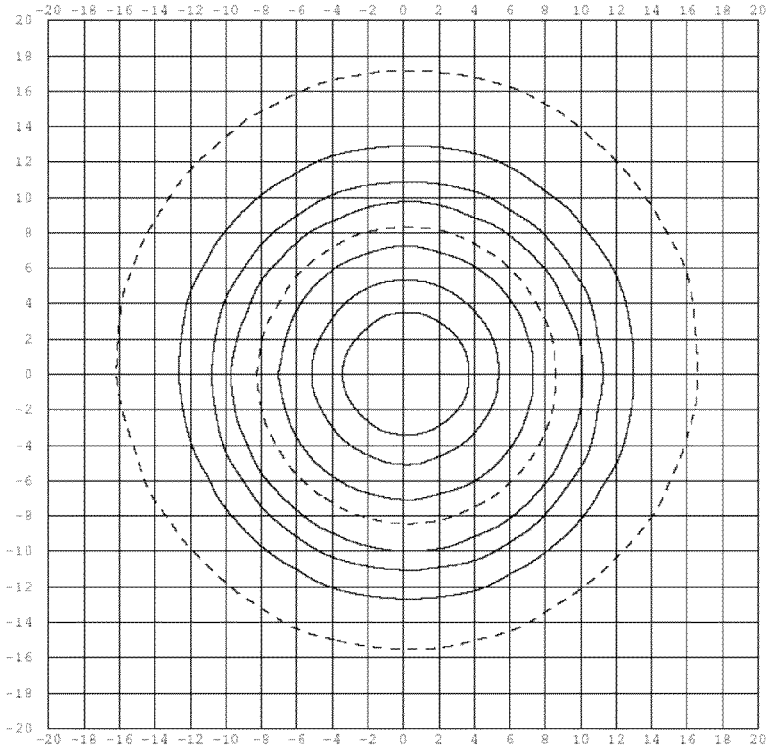
Figure 3:
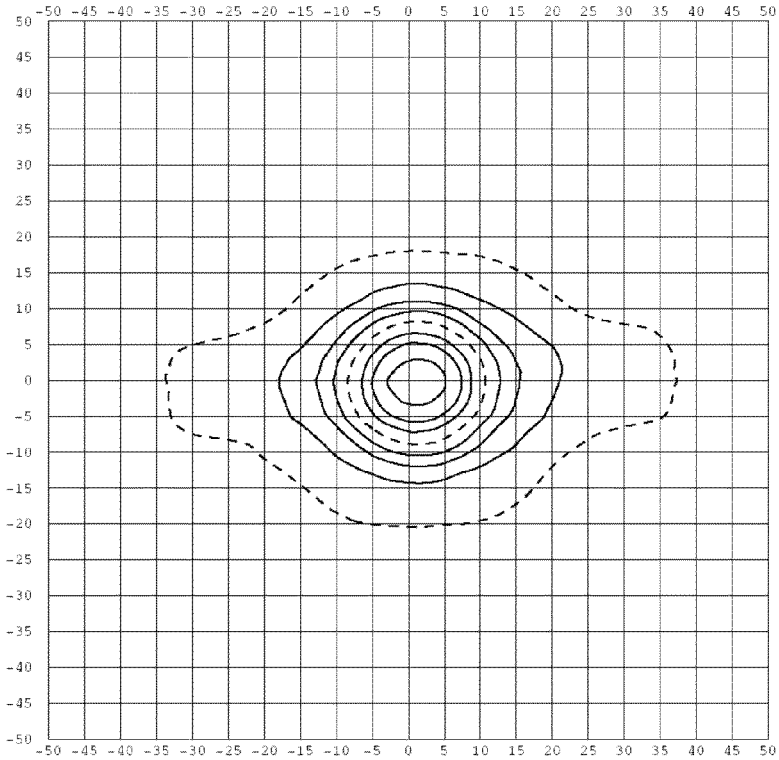

FIGS. 3A and B illustrate a comparison of beam output patterns from a conventional LED/lens arrangement (as in FIGS. 1A and B) and the envisioned LED/lens arrangement (as in FIG. 1C), respectively.

Figure 4:
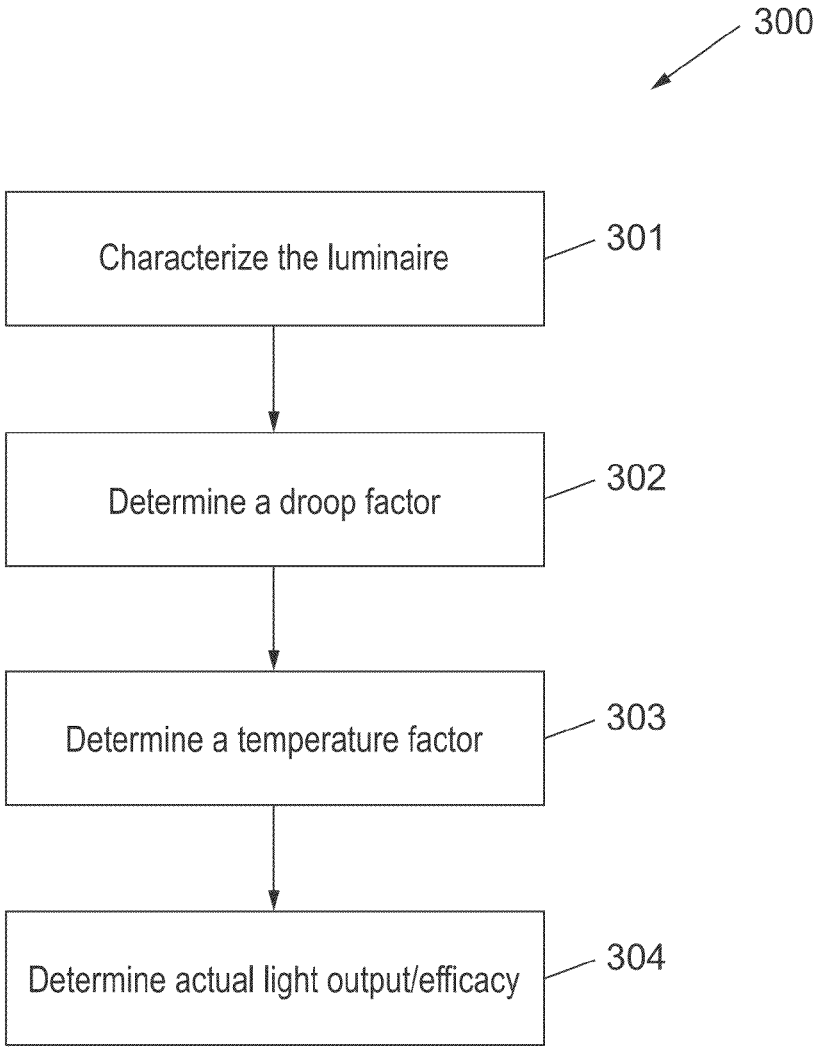

FIG. 4 illustrates, in flowchart form, one possible method of determining actual light output and/or luminous efficacy according to an aspect of the present invention.

Figure 5:
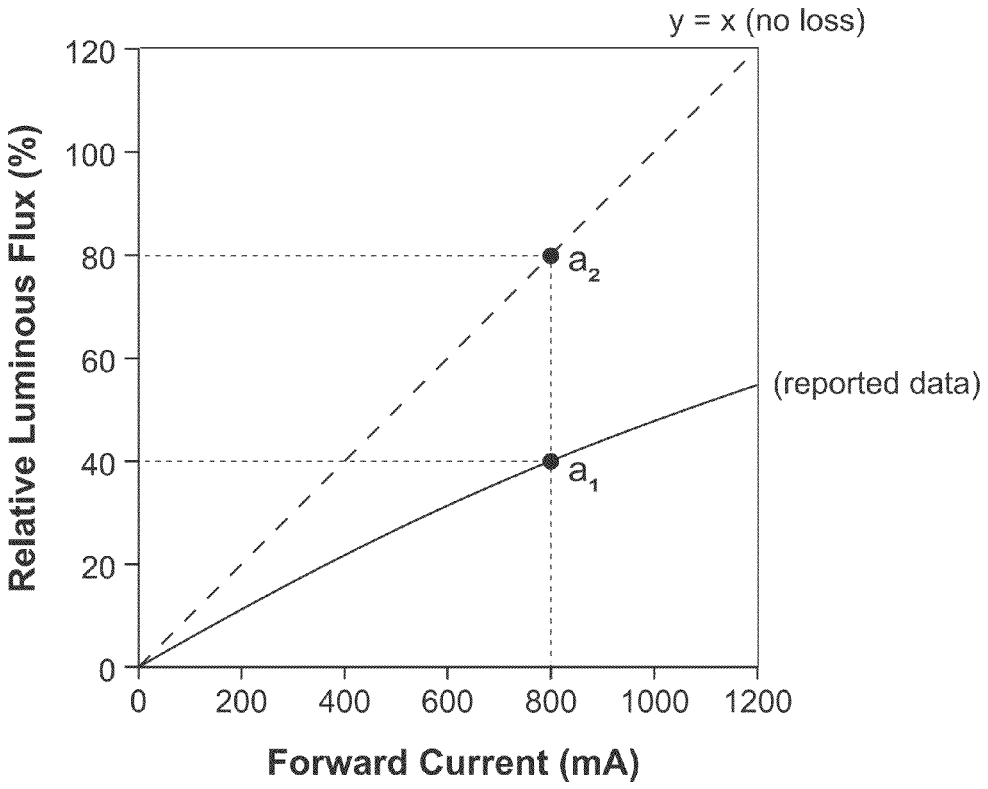

FIG. 5 diagrammatically illustrates one possible method of determining a droop factor according to an aspect of the present invention.

Figure 6:
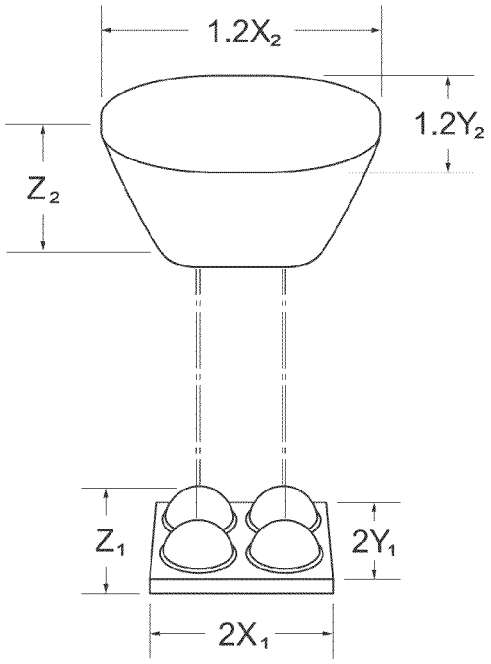
Figure 6:
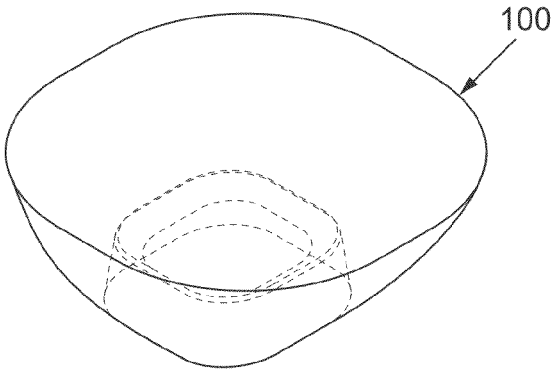

FIGS. 6A and B illustrate an alternative LED/lens arrangement—referred to herein as a quad arrangement—according to an aspect of the present invention.

Figure 7:
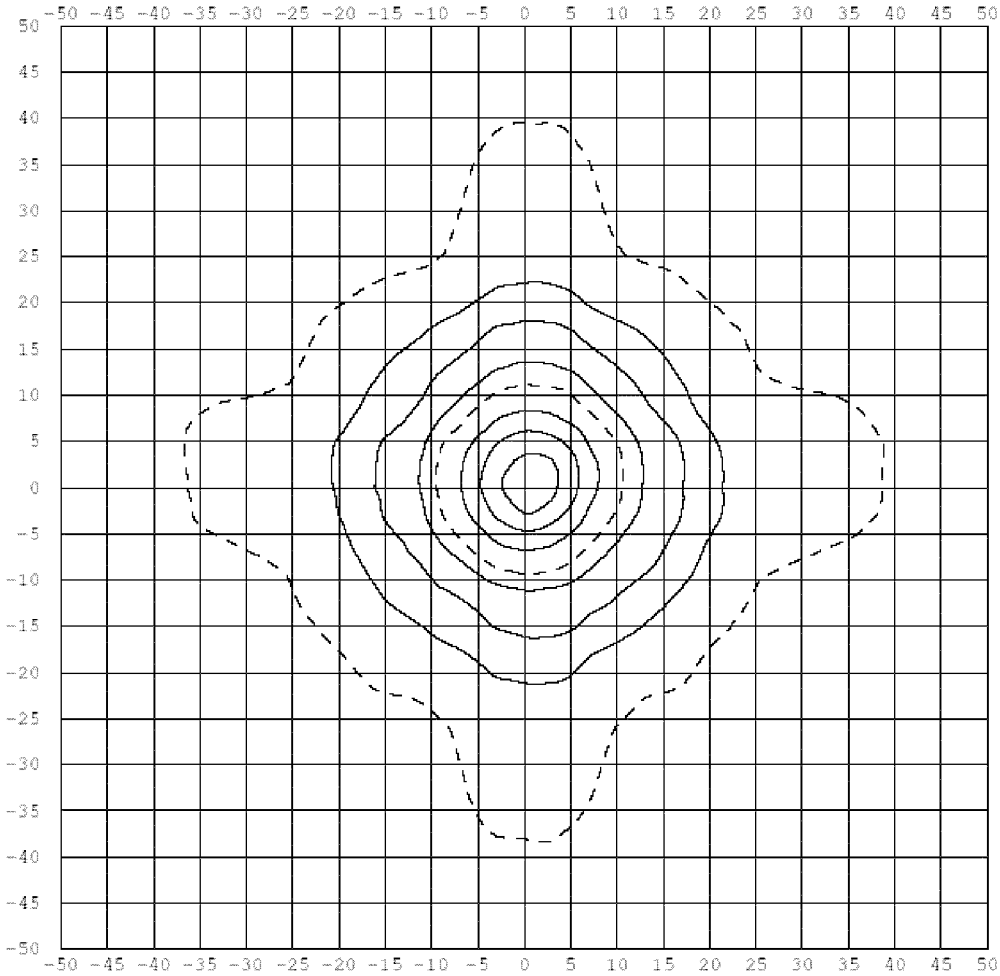
Figure 8:
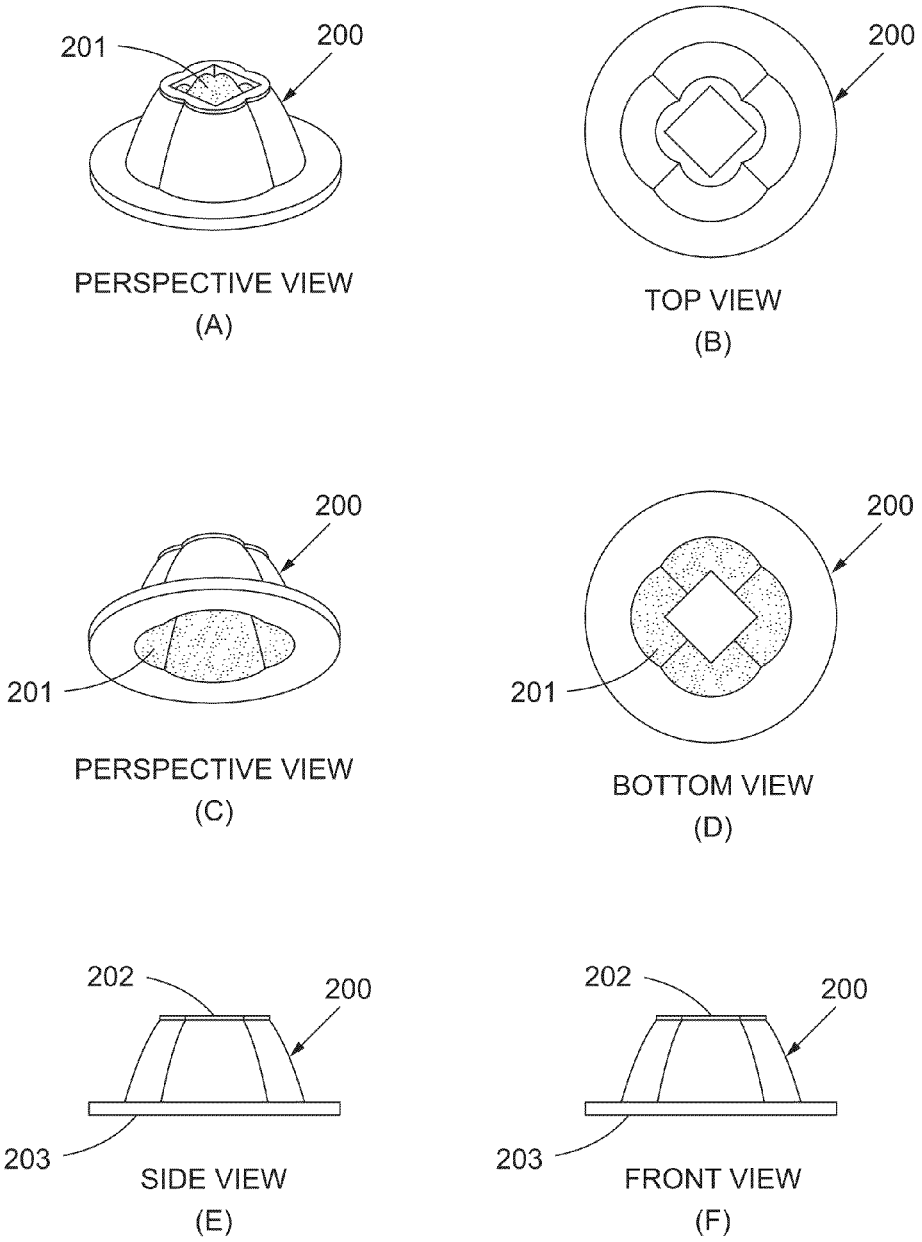

FIG. 7 illustrates a beam output pattern from the quad arrangement of FIGS. 6A and B.

FIGS. 8A-F illustrate various detailed views of a reflector according to an aspect of the present invention which may be used in place of the lens of the quad arrangement of FIGS. 6A and B to produce the beam output pattern of FIG. 7.

IV. DETAILED DESCRIPTION OF EXEMPLARY EMBODIMENTS

A. Overview

To further an understanding of the present invention, specific exemplary embodiments according to the present invention will be described in detail. Frequent mention will be made in this description to the drawings. Reference numbers will be used to indicate certain parts in the drawings. Unless otherwise indicated, the same reference numbers will be used to indicate the same parts throughout the drawings.

While aspects of the present invention may be applied to a variety of applications, luminaire designs, and models of LEDs, by way of example and not by way of limitation the following exemplary embodiments employ the luminaire described in U.S. Patent Publication No. 2012/0217897 incorporated by reference herein, and model XM-L LEDs available from Cree, Inc., Durham, N.C., USA.

Further, it is of note that the term "LED"—as it is used herein—refers to the entire LED package (i.e., primary lens, package body, and diode (also referred to as the chip or die)).

B. Exemplary Method and Apparatus Embodiment 1

Envisioned is a luminaire employing a plurality of LEDs of sufficient type and in sufficient number so to approximate the light output of a traditional HID lamp used in wide-area lighting applications; an example of the latter is model 37405 quartz metal halide lamp available from GE Lighting Headquarters, Cleveland, Ohio, USA. According to aspects of the present invention, two or more LEDs are placed side-by-side to form a linear array, a single set of optical devices used for each linear array so to reduce the cost of the luminaire—or at least reduce the increase in cost of the luminaire. So for example, a linear array of two LEDs sharing a single lens, visor, and/or reflector essentially doubles the number of LEDs without doubling the number of optical devices; in essence, doubling the light output capacity without doubling the cost. This is contrary to conventional wisdom because it is known that multi-chip LEDs are commercially available; model MC-E XLAMP® available from Cree, Inc., Durham, N.C., USA is an example.

Despite a larger footprint (i.e., requiring more physical space), it has been found that a linear array of single-chip LEDs demonstrates a comparable, if not greater, efficacy than commercially available multi-chip LEDs having the same number of diodes. Compare, for example, aforementioned model MC-E LED which, as reported by Cree, has a maximum light output of 751 lumens at 9.5 watts (79 lm/W) and the model XP-G which, as reported by Cree, has a maximum light output of 493 lumens at 4.9 watts (100 lm/W). Given that a model MC-E LED contains four chips and a model XP-G contains just one chip, it can be seen that one additional XP-G operated at 4.9 watts (a total of two single-chip LEDs) produces more light than a four-chip MC-E LED at comparable power.

Further, it has been found that arranging the single-chip LEDs in a linear array produces a beam that is somewhat spread in one plane, which can be beneficial for wide-area lighting applications where distinct cutoff is desirable. Commercially available multi-chip LEDs are typically arranged in a grid (e.g., 2×2, 4×4) and so cannot preferentially spread a beam in a plane. Of course, an elliptical lens could be used with a multi-chip LED so to approximate a beam spread in one plane but this approach does not address the lower efficacy of multi-chip LEDs.

1. Multi-Light Source Collimator

According to one aspect of the present invention, an elongated lens is formed so to accommodate the aforementioned linear array of LEDs; a comparison to traditional lenses is illustrated in FIGS. 1A-C. As can be seen in FIG. 1A, a typical single-die LED has a length $X_1$, a width $Y_1$, and a height $Z_1$; a model XM-L LED measures 5 mm, 5 mm, and 3 mm, respectively. A corresponding lens has a length $X_2$, a width $Y_2$, and a height $Z_2$; to accommodate a model XM-L LED, a typical narrow beam lens measures approximately 21 mm, 21 mm, and 11 mm, respectively. Doubling the number of LEDs in a conventional manner requires a length of $2X_2$ so to accommodate a second lens (see FIG. 1B); for two XM-L LEDs, a length of 42 mm. According to the present invention, an elongated lens only requires a length of $1.2X_2$ (25.2 mm) for two XM-L LEDs. In practice, the exact length of the elongated lens (see FIG. 1C) will depend on the number and size of LEDs in the array but will always (i) fully encapsulate the LEDs in the array and (ii) be shorter than if using the conventional method illustrated in FIG. 1B. As can be appreciated, the approach illustrated in FIG. 1C permits a more efficient packing of LEDs than the approach illustrated in FIG. 1B; perhaps even permitting one to mount all LEDs in the linear array to a common board, if desired.

FIGS. 2A-E illustrate the envisioned lens of FIG. 1C in greater detail. As can be seen from FIG. 2E, lens 100 has a generally parabolic profile intersecting an emitting face 101 (see FIG. 2B), which is typical of LED lenses. Depending on the requirements of a lighting application, emitting face 101 can be ribbed, relatively smooth (i.e., polished), prismatic, or include some other feature or design of microlens. Further, emitting face 101 can be flat, curved (convex or concave), or include an aperture (as is common in some LED lenses). As is common practice, LED adjacent face 102 of lens 100 is formed so to appropriately encapsulate the primary lens and sit flush against the package body of each LED in the array; again, one or more diodes with corresponding primary lenses could share a package body, if desired. Lens 100 may be formed of light transmitting (e.g., transparent or translucent) material using traditional molding techniques, though other forming techniques (e.g., machining) or additional processing steps (e.g., compression) may be required if lens 100 exceeds a certain length; an alternative is later discussed. The precise shape and optical characteristics of lens 100 can vary according to need or desire.

In practice, it may be beneficial to align the length of lens 100 along a plane, axis, or feature relative to the target area. For example, for a luminaire mounted near the ground and aimed up towards a target area—what is sometimes referred to as a wall wash lighting application—it may be preferential to align the length of lens 100 more or less in the vertical plane so to extend along the height of the target area. Alternatively, if the luminaire is mounted above the target area and aimed generally downward (e.g., as in FIG. 15A of aforementioned U.S. Patent Publication No. 2012/0217897), it may be preferential to align the length of lens 100 more or less in the horizontal plane so to extend along the length of the target area without adversely affecting beam cutoff provided by a visor (if the luminaire includes a visor).

FIGS. 3A and B illustrate a comparison of isocandela curves from a conventional LED/lens arrangement and the LED/lens arrangement using lens 100, respectively. As can be seen from FIG. 3A, two XM-L LEDs each with narrow beam TIR secondary lenses—corresponding to the arrangement of FIG. 1B—produce a beam output pattern which extends generally equally in all directions. Alternatively, as can be seen from FIG. 3B, two XM-L LEDs with a TIR secondary lens of the design illustrated in FIGS. 2A-E—corresponding to the arrangement of FIG. 1C—produce a beam output pattern which is similar to the pattern of FIG. 3A but elongated in one direction; note the change in scale between FIGS. 3A and B. In both cases, the field angle is denoted by the outermost broken line curve and the beam angle is denoted by the innermost broken line curve. Preliminary testing has found that the use of the envisioned lens results in very little to no loss in transmission efficiency as compared to traditional lenses; according to one test, envisioned lens 100 resulted in a 9% loss in transmission efficiency as compared to a 10% loss in transmission efficiency using a traditional narrow beam lens such as is illustrated in FIGS. 1A and B (e.g., any model of narrow beam lenses in the FCP Series for Cree XLAMP® available from Fraen Corporation, Reading, Mass., USA).

2. Methodology for Balancing Heat Management Versus Light Output

Envisioned lens 100 yields many benefits; the resulting beam is somewhat elongated in a preferred direction, lens 100 requires less space for a given number of LEDs than if the same number of LEDs each employed a lens, and it is less costly to accommodate a given number of LEDs with lens 100 than with individual lenses. Take, for example, the lighting module illustrated in FIG. 1A-C of aforementioned U.S. Patent Publication No. 2012/0217897. By using a linear array of two or three LEDs on board 200 instead of only one, and envisioned lens 100 instead of lens 400 (see FIG. 1B of the aforementioned patent application), very little modification of module 10 is required. When the alternative is to simply add more modules 10 (each with a single LED), it can be appreciated that envisioned lens 100 of the present exemplary embodiment aids in tailoring a given LED-based luminaire to wide-area lighting applications and does so in a cost-effective manner.

Of course, increasing the number of LEDs sharing a secondary lens (i.e., lens 100) and increasing the overall number of LEDs in a luminaire raises heat management concerns which must be addressed if one is to realize the aforementioned benefits of LEDs, particularly if compared to conventional HID lamps. Accordingly, there is a need for a methodology that permits one to identify an acceptable balance between heat/droop and light output, and that may be applied regardless of the number and type of LEDs used in a linear array, design of luminaire, or the like; such a methodology is illustrated in FIG. 4 and presently discussed.

As a first step (301) of method 300, a selected luminaire is characterized so to determine, in essence, how effective the luminaire is as a heat sink. Using the luminaire described in aforementioned U.S. Patent Publication No. 2012/0217897 as an example, one can readily determine the physical dimensions of the luminaire housing (see FIGS. 10A-D of the aforementioned patent application), as well as the material from which it is formed (e.g., cast aluminum alloy). Following this, one can readily determine the number and type of LEDs typically accommodated by the luminaire housing; by way of example, assume the luminaire housing typically contains 78 LED modules (see FIG. 1A of the aforementioned patent application), each employing a single XM-L LED and with a spacing of 50 mm between LEDs. Knowing the type of LED, one can readily determine the thermal resistance of the LED (as this information is available from the LED manufacturer). Knowing all this, one may use a commercially available simulation program such as Qfin 4.0 (available from Qfinsoft Technology, Inc., Rossland, British Columbia, Canada) to determine a luminaire housing temperature for a given forward current. While greatly simplified compared to more tedious (and potentially costly) analyses, for purposes of the present invention the luminaire housing temperature is assumed to be comparable to the solder point temperature (also referred to as the case temperature) of the LED array.

As a second step (302) of method 300, a droop factor is determined for the specific type of LED for a given forward current. As stated, in this example the luminaire employs 78 XM-L LEDs; assume that for a wide-area lighting application each LED is operated at 2450 mA. LED manufacturers typically provide a chart of relative flux versus forward current; the difference between a perfectly linear trend with no light loss and the reported data is used to determine a droop factor. So looking at a hypothetical example in FIG. 5, at 800 mA the reported relative luminous flux (at point $a_1$) is half of the luminous flux in the ideal case (at point $a_2$); thus, the droop factor is 0.50. For the aforementioned example of the luminaire from U.S. Patent Publication No. 2012/0217897 containing 78 XM-L LEDs operating at 2450 mA each, using model-specific information from the manufacturer, and applying the same methodology as illustrated in FIG. 5, a droop factor of 0.66 is determined.

As a third step (303) of method 300, a temperature factor is determined to account for the discrepancy between data at 25° C. and the actual junction temperature—as it is not feasible to operate an actual wide-area lighting system at 25° C.—as well as to account for other losses associated with increased temperature. As previously stated, characterization of the luminaire housing according to step 301 of method 300 permits one to determine a luminaire housing temperature for a given forward current, the housing temperature assumed to be comparable to the solder point temperature of the LED array. By way of example, assume said characterization yields a housing temperature of 90° C. when the LEDs are operated at 2450 mA. Knowing the thermal resistance between the junction and case of XM-L LEDs to be 2.5° C./W (as this is provided by the manufacturer) and knowing the power to be 8 W at 2450 mA for XM-L LEDs (as this is provided by the manufacturer or is easily derived based on other information provided by the manufacturer), an actual junction temperature may be determined according to the following equation:

$$T_{jLED}=T_{spa}(R_{jc}*P_{LED}) \quad (1)$$

where $T_{jLED}$ is the actual junction temperature of each LED in the array, $T_{spa}$ is the solder point temperature of the LED array, $R_{jc}$ is the thermal resistance of the LEDs, and $P_{LED}$ is the wattage of each LED in the array. For the specific example outlined above, $T_{jLED}$=90° C.+(2.5° C./W*8 W)=110° C.

LED manufacturers typically provide a chart of relative flux versus junction temperature for a specified forward current; using this chart one may determine a temperature factor based on $T_{jLED}$. Of course, if the forward current of the reported data is not similar to the actual operating condition (e.g., if the manufacturer reports relative flux versus junction temperature at 750 mA whereas in this example forward current is 2450 mA), one could still use the reported data, but it may be preferable to perform independent testing or obtain more representative data. Assuming the reported data to be adequate and having calculated a junction temperature of 110° C. for one XM-L LED operating at 2450 mA, one may look to the relative flux versus junction temperature curve and find the corresponding relative luminous flux to be 82%; thus, the temperature factor is 0.82.

The final step (304) of method 300 is to determine an actual light output and/or efficacy of the LED array taking into account luminaire design, LED type, and operating conditions. Having the droop and temperature factors in hand, and knowing a rated efficacy (as this is provided by the manufacturer), one may calculate the actual light output and/or efficacy. Assuming a rated efficacy of 161 lm/W for XM-L LEDs, the actual light output and efficacy may be determined according to the following equations:

$$\Phi_a=LE_r*P_{LED}*DF*TF*n \quad (2)$$

$$LE_a=\Phi_a/(P_{LED}*n) \quad (3)$$

where $\Phi_a$ is the actual light output of the array, $LE_r$ is the rated luminous efficacy, $P_{LED}$ is the wattage of each LED in the array, DF is the droop factor, TF is the temperature factor, n is the number of LEDs in the array, and $LE_a$ is the actual luminous efficacy. So for the example outlined according to the present embodiment, $\Phi_a$=161 lm/W*8 W*0.66*0.82*1=697 lm and $LE_a$=697 lm/(8 W*1)=87 lm/W.

Assume now that instead of using a single XM-L LED in an LED module with a traditional lens (see FIG. 1B of aforementioned U.S. Patent Publication No. 2012/0217897) driven at 8 W, two XM-L LEDs are used in an LED module with envisioned lens 100 and driven at 4 W each; an application of method 300 demonstrates a preferable change in efficacy.

According to step 301, the luminaire housing is characterized. One could re-run the analysis (e.g., via Qfin or other program) but given that the type of LED is unchanged and the footprint of the LED array increases by only a few millimeters—which is actually advantageous as it transfers more heat to the luminaire housing, and therefore, away from the LED—the housing temperature would likely only vary by a small amount. As such, the results from the initial housing characterization will be used in this alternative scenario.

According to step 302, a droop factor is determined for the specific type of LED for a given forward current; assume that for an XM-L LED, operating at 4 W correlates to 1300 mA (again, this data is typically supplied by the LED manufacturer or can be derived from data supplied by the LED manufacturer). Using model-specific information from the manufacturer and applying the same methodology as illustrated in FIG. 5, a droop factor of 0.80 is determined.

According to step 303, a temperature factor is determined. The housing temperature used to approximate the solder point temperature in the first example is used for the solder point in this alternative scenario because the total power is the same for two XM-L LEDs connected in series and operated at 4 W each as for one XM-L LED operated at 8 W. Thus, using the same solder point temperature and thermal resistance (as the type of LED has not changed), one may use equation (1) to calculate $T_{jLED}$; in this example, $T_{jLED}$=90° C.+(2.5° C./W*4 W)=100° C. Using 100° C. as the actual junction temperature of each LED in the array, one may find a corresponding relative luminous flux per the appropriate manufacturer-supplied (or independently developed) relative flux versus junction temperature curve; assuming the corresponding relative flux is 84%, the temperature factor is 0.84.

According to step 304, an actual light output and/or efficacy is determined according to equations (2) and (3), respectively. Using the results from steps 301-303 for this alternative scenario, $\Phi_a$=161 lm/W*4 W*0.80*0.84*2=866 lm and $LE_a$=866 lm/(4 W*2)=108 lm/W. So it can be seen for this particular example that the added cost of one LED per module—and no added power cost as power is not increased—results in a 24% increase in efficacy over a traditional LED/ lens arrangement. In this manner, one may balance cost versus efficacy, forward current versus light loss, or some other combination of factors so to determine what is acceptable for a combination of LEDs and luminaire.

C. Exemplary Method and Apparatus Embodiment 2

In some situations, a combination of factors could steer one away from a linear array of LEDs even if the corresponding beam output pattern is desirable. For example, one may find that to achieve a target efficacy for a given size of luminaire, a linear array of LEDs does not permit adequate packing of light sources in the available space. In some situations it may be preferable to produce a beam output pattern symmetric about all axes. In some situations it may be found that for a given model of LED, light losses are more readily attributed to droop than to increased temperature. In such a situation, to achieve a desired efficacy one may need to consider including more LEDs per lens so to diminish the effects of droop while accepting an increase in overall temperature. For whatever reason, it is not a departure from aspects according to the present invention to design a non-linear array for use with envisioned lens 100; this alternative embodiment is illustrated in FIGS. 6A-B and 7.

As can be seen from FIG. 6A, a non-linear array of LEDs (referred to hereafter as a quad array) has the same length ($2X_1$) and height ($Z_1$) as in the previous embodiment but twice the width ($2Y_1$)—see also FIG. 1C. One possible design of corresponding lens is illustrated in FIGS. 6A and B; as can be seen, the quad array lens 100 has the same length ($1.2X_2$) and height ($Z_2$) as in the previous embodiment, and a width of $1.2Y_2$. Again referencing XM-L LEDs which measure 5 mm×5 mm×3 mm, a conventional approach (as in FIG. 1B) would require a space measuring approximately 42 mm×42 mm×11 mm. Alternatively, a lens according to the present embodiment only requires a space measuring 25.2 mm×25.2 mm×11 mm. Again, the exact dimensions of the envisioned lens will depend on the number and size of LEDs in the array, as well as the layout of said LEDs within the array, but will always (i) fully encapsulate the LEDs in the array and (ii) be more compact than if using the conventional method illustrated in FIG. 1B.

FIG. 7 illustrates the isocandela curves from the LED/lens arrangement of FIGS. 6A and B; as can be seen, the beam output pattern extends generally equally in all directions. Again, preliminary testing has found that the use of the envisioned lens results in very little to no loss in transmission efficiency as compared to traditional lenses.

Method 300 is applied in a similar fashion as in Embodiment 1. In this scenario, instead of using a single XM-L LED in an LED module with a traditional lens driven at 8 W, four XM-L LEDs are used in the quad array lens (see FIGS. 6A and B) and driven at 2 W each. An application of method 300 demonstrates a preferable change in efficacy.

As for the linear array in Embodiment 1, the results from the initial housing characterization are used to satisfy step 301. According to step 302, a droop factor is determined for the specific type of LED for a given forward current; assume that for an XM-L LED, operating at 2 W correlates to 690 mA (again, this data is typically supplied by the LED manufacturer or can be derived from data supplied by the LED manufacturer). Using model-specific information from the manufacturer and applying the same methodology as illustrated in FIG. 5, a droop factor of 0.89 is determined.

According to step 303, a temperature factor is determined. The housing temperature used to approximate the solder point temperature in Embodiment 1 is used for the solder point in this alternative scenario because the total power is the same for four XM-L LEDs connected in series and operated at 2 W each as for one XM-L LED operated at 8 W. Thus, using the same solder point temperature and thermal resistance (as the type of LED has not changed), one may use equation (1) to calculate $T_{jLED}$; in this example, $T_{jLED}$=90° C.+(2.5° C./W*2 W)=95° C. Using 95° C. as the actual junction temperature of each LED in the array, one may find a corresponding relative luminous flux per the appropriate manufacturer-supplied (or independently developed) relative flux versus junction temperature curve; assuming the corresponding relative flux is 87%, the temperature factor is 0.87.

According to step 304, an actual light output and/or efficacy is determined according to equations (2) and (3), respectively. Using the results from steps 301-303 for this alternative embodiment, $\Phi_a$=161 lm/W*2 W*0.89*0.87*4=997 lm and $LE_a$=997 lm/(2 W*4)=125 lm/W. So it can be seen for this particular example that the added cost of three LEDs per module—and no added power cost as power is not increased—results in a 44% increase in efficacy over a traditional LED/lens arrangement.

There are things to note in this alternative embodiment. Firstly, it can be seen that in the present embodiment—compared to the linear array—there is a greater change in the droop factor (0.89 versus 0.80) than the temperature factor (0.87 versus 0.84). This speaks to the nature of light loss in LEDs and highlights the importance of taking droop into account when determining efficacy (something not routinely done in the current state of the art). Secondly, it provides an opportunity to warn of the risk of making too many assumptions in the use of method 300. In this alternative embodiment, four LEDs per module were used instead of one LED per module, though the luminaire housing temperature as determined by Qfin (or analogous program) was assumed to be the same for both cases, and further assumed to be representative of the solder point temperature of the LED array. Application of equation (1) shows that the junction temperature of each LED in the array in the present embodiment is decreased as compared to the traditional single-die LED/lens combination, but in practice 234 extra LEDs have been added to the luminaire. One should be mindful that all luminaires have a limit beyond which they are no longer effective heat sinks and any assumptions to method 300 should be made accordingly.

D. Options and Alternatives

The invention may take many forms and embodiments. The foregoing examples are but a few of those. To give some sense of some options and alternatives, a few examples are given below.

While the exemplary embodiments are taken with respect to a particular model of LED, design of luminaire, and layout of LEDs within said luminaire, it can be appreciated that aspects according to the present invention could be applied to other models of LED and designs of luminaire, as well as a variety of layouts or arrays of LED. As one example, the luminaire could comprise a flexible tubular lighting device (also referred to as a rope light); this particular design of luminaire may be well suited to a linear array of LEDs sharing a single lens.

Further, aspects according to the present invention could be applied to other types of light sources, perhaps even light sources which do not experience droop; if this is the case, step 302 could be omitted from method 300 and not depart from aspects according to the present invention. Alternatively, technological advancement of LEDs could result in eliminating droop—which would likewise permit removal of step 302 from method 300.

Still further, while the exemplary embodiments are taken with respect to wide-area lighting, it can be appreciated that aspects according to the present invention could be applied to other types of lighting applications. For example, aspects according to the present invention could be applied to indoor track or pendant lighting applications which are typically small in scale and architectural in nature. Alternatively, aspects according to the present invention could be applied to outdoor floodlight applications which can range both in scale and utilitarianism.

As envisioned, lens 100 is designed to operate as a secondary lens for one or more LEDs in an array. While it is possible to use lens 100 as a primary lens (i.e., with a bare chip), the loss in transmission efficiency would likely diminish any benefit. That being said, efficiency loss could be mitigated by including an index matching fluid to bridge the gap between the chip and lens 100; U.S. patent application Ser. No. 13/030,932 incorporated by reference herein discusses such an approach.

As further envisioned, lens 100 of FIGS. 2A-E is designed to produce a narrow beam output pattern, albeit elongated along the length of lens 100; this is but an example. By changing the profile of lens 100 (see FIGS. 2C and E), the shape and/or structure of face 101 (see FIG. 2B), the material from which lens 100 is comprised, or by any other means, the beam output pattern of lens 100 may be changed to suit an application, approximate a known beam type (e.g., as defined by NEMA), or the like; compare, for example, the beam output pattern of linear array lens 100 (FIG. 3B) and the beam output pattern of quad array lens 100 (FIG. 7).

Further regarding lens 100, it has been stated that there is a limit to the size of optic that can be made to fit LEDs and still be formed by cost-effective molding techniques; lens 100 is not immune to this limitation. As such, an application employing a large number of LEDs in an array may benefit from a different kind of optic; one possible example is reflector 200 illustrated in FIGS. 8A-F. Reflector 200, as envisioned, is a direct replacement for the quad array lens (see FIGS. 6A and B) and generally comprises an LED adjacent face 202, an emitting face 203, and a reflective interior 201. Like LED adjacent face 102 of lens 100, LED adjacent face 202 of reflector 200 is formed so to appropriately encapsulate the primary lens and sit flush against the package body of each LED in the array; again, one or more diodes with corresponding primary lenses could share a package body, if desired. However, unlike emitting face 101 of lens 100, emitting face 203 of reflector 200 is not in the direct path of the light emitted from the LEDs. Rather, emitting face 203 acts more as a flange so to aid in positionally affixing reflector 200 within the aforementioned LED module. In practice, reflector 200 could be formed from a variety of materials and interior 201 processed so to produce a desired finish, specularity, reflectivity, or the like; as one example, reflector 200 could be formed from a low-cost plastic and interior 201 metalized according to state of the art practices.

With respect to method 300, it can be appreciated that the values reported and/or calculated in the exemplary embodiments are only examples; the exact types of data available from a manufacturer, as well as the value of those data, may vary.

With further respect to method 300, it should be noted that an analysis of luminaire efficiency has not been taken into account. That being said, the coefficient of utilization or the like could be included in method 300 so to provide another factor for one to balance.

Still further, as laid out in the exemplary embodiments method 300 assumes all LEDs are of the same type and quantity between modules in the luminaire; this is only by way of example. Though the complexity of equations (1)-(3) may increase, it is not a departure from aspects according to the present invention to mix types and quantities of light sources within a luminaire.

What is claimed is:

1. A method of determining efficacy of one or more light sources in a luminaire housing for a given set of operating conditions comprising:

a. thermally characterizing the luminaire housing for effectiveness as a heat sink comprising determining a housing temperature for the given set of operating conditions based on one or more of:
   i. a physical dimension of at least a portion of the luminaire housing;
   ii. a property of one or more materials from which the luminaire housing is comprised;
   iii. the number of light sources in the luminaire housing;
   iv. a thermal property of a light source in the luminaire housing; and
   v. spacing between at least some of the light sources in the luminaire housing;

b. determining one or more light source output degradation factors for the one or more light sources at the given set of operating conditions based, at least in part, on (i) a measured light output of said one or more light sources at one or more operating conditions, and (ii) the thermal characterization of the luminaire housing or a deviation between the light output measurements and a reference data at the given set of operating conditions; and c. predicting actual light output and/or efficacy of the one or more light sources at the operating conditions based on (i) the thermal characterization of the luminaire housing, (ii) a rated efficacy of the one or more light sources, and (iii) the one or more degradation factors.

2. The method of claim 1 wherein the given set of operating conditions comprises an assumed forward operating current for the light sources when said light sources are operated in series.

3. The method of claim 1 wherein the one or more degradation factors comprise one or more of:

a. lumen depreciation of the light source relating to the given set of operating conditions;

b. lumen depreciation relating to other than the light sources.

4. The method of claim 2 wherein the light sources are solid state light sources and the one or more degradation factors comprises:

a. a temperature factor related to junction temperature of the solid state light sources; and b. a droop factor related to droop of the solid state light sources.

5. The method of claim 4 wherein the step of determining the temperature factor comprises:

a. deriving a ratio between the measured light output and a junction temperature of at least one of the said solid state light sources wherein said junction temperature is determined, at least in part, on the thermal characterization of the luminaire housing.

6. The method of claim 4 wherein the step of determining the droop factor comprises:

a. deriving a ratio between the measured light output and the reference data at the forward current for the solid state light sources operating in series.

7. The method of claim 6 wherein the measured light output is derived from a light source manufacturer and the reference data assumes no light loss.

8. The method of claim 1 wherein the step of predicting actual light output and/or efficacy of said light sources comprises:

a. multiplying the rated luminous efficacy by a cumulative number and power of all said light sources in the luminaire housing; and b. adjusting that product by:

i. a droop factor; and ii. a temperature factor.

9. The method of claim 8 wherein the predicted actual light output and/or efficacy is used to:

a. design a luminaire and a corresponding beam output pattern issued therefrom;

b. select a configuration of light source arrays related to a number of light sources per area or space in the luminaire housing;

c. compare two luminaries of different light source, luminaire housing, or assumed operating conditions;

d. alter the design of a luminaire;

e. operate a luminaire; or f. adjust operation of a luminaire.

10. The method of claim 1 further comprising using the predicted actual light output and/or efficacy to achieve a target efficacy for a given luminaire housing.

11. The method of claim 1 further comprising using the predicted actual light output and/or efficacy to select a configuration for at least some of the light sources.

12. The method of claim 11 wherein the configuration comprises an optical component and at least some of said light sources in a linear array, with the array sharing the optical component.

13. The method of claim 12 wherein the optical component comprises a lens, a reflector, and/or a visor.

14. The method of claim 11 wherein the configuration comprises an optical component and least some of the light sources in a non-linear array, with the array sharing the optical component.

15. The method of claim 1 further comprising a lens for use with one or more light sources which share the lens, the lens comprising:

a. a lens body extending between:

i. a first surface which is formed to substantially encapsulate light-emitting portions of said one or more light sources which share the lens; and ii. a second surface from which light from the one or more light sources which share the lens issues.

16. The method of claim 1 further comprising a reflector for use with one or more light sources which share the reflector, the reflector comprising:

a. a reflector body having:

i. a proximal portion through which the light-emitting portions of the one or more light sources which share the reflector at least partially extends;

ii. a reflective surface which captures and redirects at least some of the light emitted from the light sources which share the reflector;

iii. a distal portion from which (i) light emitted from the light sources and (ii) said captured and redirected light issues.

17. The method of claim 16 wherein the one or more light sources are placed in a linear array.

18. The method of claim 15 wherein the second surface is one of:

a. flat;

b. curved;

c. dimpled;

d. prismatic;

e. ribbed;

f. having a design of microlens; or g. having a void.

19. The method of claim 15 wherein the body has a generally parabolic profile.

* * * * *

UNITED STATES PATENT AND TRADEMARK OFFICE

CERTIFICATE OF CORRECTION

PATENT NO. : 8,866,406 B2
APPLICATION NO. : 13/623153
DATED : October 21, 2014
INVENTOR(S) : Myron Gordin et al.

It is certified that error appears in the above-identified patent and that said Letters Patent is hereby corrected as shown below:

In the Claims,

Col. 13, Claim 9, Line 17:
DELETE after two "luminaries"
ADD after two --luminaires--

Col. 13, Claim 14, Line 35:
ADD after and --at--

Signed and Sealed this
Seventeenth Day of February, 2015

Michelle K. Lee

Michelle K. Lee
*Deputy Director of the United States Patent and Trademark Office*